United States Patent [19]

Hill et al.

[11] Patent Number: 4,597,330

[45] Date of Patent: Jul. 1, 1986

[54] DEPOSITORY ENVELOPE PRINTING MECHANISM

[75] Inventors: Jeffrey A. Hill; Robert L. Yohn; Ashok L. Modi; Kevin H. Newton, all of Stark County, Ohio

[73] Assignee: Diebold, Incorporated, Canton, Ohio

[21] Appl. No.: 675,670

[22] Filed: Nov. 28, 1984

[51] Int. Cl.[4] ..... B41J 3/00

[52] U.S. Cl. ..... 101/93.01; 109/24.1; 235/379; 346/22

[58] Field of Search ..... 109/24.1; 101/93.01, 101/93.04, 72, 78, 426, 42–43; 346/22; 235/379; 194/DIG. 26

[56] References Cited

U.S. PATENT DOCUMENTS

| | | | |
|---|---|---|---|
| 3,078,789 | 2/1963 | McGee | 346/22 |
| 3,104,314 | 9/1963 | Simjian | 346/22 |
| 3,836,980 | 9/1974 | Grosswiller, Jr. | 346/22 |
| 3,897,901 | 8/1975 | Grosswiller, Jr. | 346/22 X |
| 3,937,925 | 2/1976 | Boothroyd | 346/22 X |
| 3,975,226 | 8/1976 | Boettcher | 156/361 X |
| 4,092,934 | 6/1978 | Sayer | 109/24.1 |
| 4,308,804 | 1/1982 | Guibord et al. | 109/24.1 |
| 4,404,649 | 9/1983 | Nunley et al. | 235/379 X |
| 4,436,182 | 3/1984 | Simonotti et al. | 235/379 X |

*Primary Examiner*—E. H. Eickholt
*Attorney, Agent, or Firm*—Ralph E. Jocke

[57] ABSTRACT

A depository envelope printing apparatus prints transaction identifying characters on envelopes deposited into an ATM, which envelopes may be of uneven contour as a result of their containing coins or folded notes or instruments. The apparatus includes a print head (120) and a tracking shoe (121) mounted on a carriage plate (110). The carriage plate is floatably mounted inside the ATM such that the tracking shoe tracks a depository envelope surface which is to accept printing as the envelope is being moved from the ATM customer to a place of storage within the ATM by a transport mechanism. The movements of the tracking shoe are transmitted to the print head so that it follows the contour of the envelope while printing is performed thereon. A probe located ahead of the tracking shoe in the direction of the envelope path tracks the level of the envelope surface a distance in advance of the tracking shoe. The probe is connected to an electrical switch which operates to interrupt the operation of the print head whenever the contour of the envelope between the areas tracked by the probe and the tracking shoe is so large that successful printing cannot be carried out on that portion of the envelope.

24 Claims, 12 Drawing Figures

DEPOSITORY ENVELOPE PRINTING MECHANISM

TECHNICAL FIELD

This invention relates to an improved device for labeling envelopes deposited into Automatic Teller Machines (ATMs) or other devices adapted to receive and label depository envelopes. An ATM is generally actuated by a customer inserting a debit or credit card which contains encoded information which identifies the customer and his account with the bank or other financial institution operating the ATM. Usually ATMs have a customer interface panel which incorporates a keyboard through which the customer can transmit information and give instructions to the ATM. When a customer wishes to deposit checks or currency into his account using the ATM, he inputs through the keyboard the information that he wishes to make a deposit and communicates the amount or value of the items which will be deposited. These inputs are transformed into electrical signals and transmitted to the computer which controls the operation of the ATM. In order to keep the items deposited by the customer separate from other deposited items, the customer is instructed through a screen on the customer interface panel to place the deposited items in a sealed depository envelope which is then moved via a transport mechanism such as that described in U.S. patent application Ser. No. 597,230 from the customer to a safe or other secure location within the ATM.

To applicant's knowledge no means exists by which the value of the items deposited in the envelopes can be verified at the time the deposit is made into the ATM. Therefore the amount credited to a customer's account for a deposit must be based on information supplied by the customer. As the amount of the deposit indicated by the customer is not always reliable due to error or deliberate misrepresentation, it is necessary that each envelope deposited be labeled with information which identifies each transaction. This allows the financial institution or other ATM operator to verify that the customer deposited the amount he indicated. The transaction identifying information usually consists of a four (4) digit number. The verification process entails manual comparison of the contents of each depository envelope with information contained in a data storage area of the computer which operates the ATM concerning the amount of the deposit associated with each transaction number.

The transaction verification process is time consuming. It requires determining the value of the items deposited in the envelopes, reading the transaction numbers printed on the envelopes, and then checking the amount of each deposit as indicated in computer data storage against the value of the items contained in the envelope. If an error is found during the verification process, the customer's name and account number must be retrieved from data storage, an appropriate adjustment made in the customer's account balance, and the customer notified of the error.

In recent years it has become common for banks and other institutions to operate networks of shared ATMs. This complicates the verification process as deposits made into the ATM may be for accounts in many different institutions. This requires that the transaction number printed on the envelopes additionally be associated with stored data concerning the financial institution into which the deposit has been made.

BACKGROUND ART

Envelope labeling devices known in the prior art are generally of two types. One type of device employs a conventional stamper impact printing mechanism located adjacent to the path of the envelope through the depository transport. This type of device is rigidly mounted adjacent to the envelope path so that transaction identifying information can be printed directly upon the envelope. Such devices are disclosed in U.S. Pat. Nos. 3,836,980 and 4,085,687. The problem with devices of this type is that the envelope must be located in close proximity to the face of the print mechanism if legible printing on the envelope is to be accomplished. Further, the depository envelopes must be held stationary in the transport while printing is conducted. ATM customers frequently place coins or folded currency or instruments in the envelopes deposited into ATMs. This results in envelopes having uneven thickness. The variable thickness often results in the envelope losing contact with the face of the printing mechanism, resulting in a failure to print identifying information.

Other prior art devices have attempted to overcome the problems associated with having to print identifying information on deposit envelopes of uneven thickness by first printing the transaction identifying information on a label and then applying the label to the depository envelope. U.S. Pat. No. 4,435,243 is an example of a device of this type. Several problems exist with these devices, however. First, the labels add to the cost of operating the ATM. Also, the labels must periodically be replenished, resulting in additional labor costs. Labels stored inside an ATM require additional space which may require the ATM to be larger. Generally labels are transported on a carrier media and once the label is applied, the media must be stored and ultimately disposed of, adding additional labor costs to the operation of the ATM. Customers frequently place their deposits in wet or soiled envelopes. In these circumstances, labels will not adhere to the envelope surface.

Prior art devices such as those cited hereinabove require that the envelope be held stationary while the identifying information is printed or applied by means of a label. To ensure that all identifying information is legibly applied to the envelope, it is common practice to apply the information at two different locations on the envelope. This requires that the envelope be stopped on two occasions during transport to apply the information. Starting and stopping the envelope transport to apply the information is time consuming. These constraints limit the speed at which deposit transactions can be completed using an ATM.

A further limitation of prior art devices is that they utilize conventional stamper impact printing devices to print the transaction identifying information on deposit envelopes. The size of such devices limits the quantity and type of information that can be printed. Usually such devices have been limited to printing four (4) digits. The verification process could be greatly expedited if additional transaction verifying information could be printed on the envelope in human or machine readable form. Such information might include the name of the financial institution into which the deposit is made, the value of the items contained in the deposit envelope, the account number into which the deposit is made, and the date and time of the deposit. Such information is readily available at the ATM at the time the deposit is made and is usually included on the statement which the ATM provides to the customer as a record of each transaction. Unfortunately, prior depository envelope devices are not capable of printing these types of information.

As a result of the foregoing limitations, there is a need for a device which can print identifying information directly onto an ATM depository envelope of uneven thickness. In addition, there is a need for a device which can print the identifying information on the envelope a number of times without requiring that the envelope be stopped as it is transported from the customer to the secure container in the ATM. Further, there is a need for a device which can print a variety of alpha-numeric transaction identifying information in machine or human readable form on depository envelopes.

DISCLOSURE OF INVENTION

It is an object of the present invention to provide a device capable of printing deposit identifying information directly on a depository envelope of uneven thickness.

It is a further object of the invention to provide a device capable of printing identifying information on a depository envelope a number of times without requiring that the envelope be stopped each time such information is applied.

It is a further object of the invention to provide a device which will print a wide variety of transaction identifying information on a depository envelope in human or machine readable form.

It is a further object of the invention to provide a device which will sense the contour of a depository envelope and prevent the printing of identifying information on the portions of the envelope where printing would be distorted or illegible due to excessive changes in contour.

It is a further object of the invention to produce a device which will interrupt the printing of transaction identifying information on a depository envelope when excessive contour of the envelope would result in illegible or distorted pfinting and recommence printing from the point of interruption when the contour is again sufficient to recommence legible printing.

Further objects of the invention will become apparent in the attached description and appended claims.

The invention of the present application achieves the foregoing objects by providing a means of printing a variety of selected transaction identifying information on a depository envelope of uneven contour deposited into an ATM, while the envelope is being transported from the customer to a secure compartment within the ATM. A customer using an ATM incorporating the preferred form of the present invention inputs encoded information concerning his identity, his bank or other institution, and his account by inserting a plastic card into the ATM. The control circuitry of the ATM decodes the encoded information, translates it into electrical signals, and transmits it to the computer which controls the operation of the ATM. If the computer controlling the ATM does not contain data on the customer's account, the information is routed electronically to the computer at the customer's bank. If the encoded information input by the customer corresponds to information contained in the data storage area of the computer at the customer's bank, the customer is then permitted to further operate the ATM. Through the keyboard of the ATM the customer communicates his desire to conduct a particular transaction, such as to make a deposit as well as the amount of such deposit. The information input through the keyboard is likewise translated into electrical signals and transmitted to the computer. The computer through control circuitry in the ATM then actuates a device which presents the customer with an envelope into which he places the bills or instruments he intends to deposit. Control circuitry likewise opens the entrance of a secure envelope transport mechanism so that the depository envelope may be accepted into the ATM.

Upon insertion of the envelope into the entrance of the transport by the customer, the envelope is captured and conveyed toward a secure container at the exit of the transport in which the envelope will eventually be stored. The transport mechanism comprises a fixed conveyor belt assembly and an upper adjacent floating platen assembly, both of which are housed in a frame. The action of the upper flight of the conveyor belt against the lower face of the floating platen causes the envelope to be pulled between the conveyor belt and floating platen assemblies and to move along at a uniform speed with the upper flight of the conveyor belt toward the discharge end of the transport.

A distance inside the transport the leading edge of the envelope contacts a probe. The probe is adapted to ride upon and follow the contour of the upper face of the depository envelope. The probe is pivotally mounted to a printer carriage plate hereinafter described and is associated with a first electrical switch means mounted to the carriage plate.

As the envelope travels further into the transport past the probe, the envelope contacts a tracking surface portion of a tracking shoe on the printer carriage plate. The printer carriage plate is pivotally mounted to the frame of the transport and adapted so that the tracking surface engages and rides upon the upper face of the envelope as it is moved past the tracking surface by the transport.

The switch means associated with the probe is mounted to the carriage plate such that the switch means will have one electrical position when the portions of the upper face of the envelope contacted by the probe and tracking surface are at approximately the same level and a second electrical position when the portions of the upper face of the envelope so contacted are not level. The electrical condition representing that the portions the envelope face sensed by the probe and the tracking surface are at the same level indicates to the computer controlling the operation of the envelope depository labeling mechanism that the contour of the depository envelope between the portions is sufficiently flat to accept legible printing.

A print head is rigidly mounted to the carriage plate in close proximity to the tracking surface. The print head is electrically connected to the computer which controls the operation of the depository labeling mechanism. The computer is programmed so that it can operate the print head to produce a series of dots on the envelope surface, such dots being spaced apart by the movement of the envelope to produce letters, numerals, or machine readable characters. The face of the print head at which the characters are produced may be recessed perpendicularly away from the tracking surface a distance which is optimal for printing on the upper face of the envelope surface. As the envelope passes further into the transport past the carriage plate, it contacts and deflects sensor tabs. The sensor tabs are connected to a second electrical switch means which changes its electrical position upon the deflection of the tabs. The second electrical switch means is electrically connected to the computer. The change in electrical condition of the second switch means upon deflection of the tabs indicates to the computer that the leading edge of the envelope has passed beyond the print head and that printing operations may be commenced unless or until an electrical signal is received from the first electrical switch means indicating that the depository envelope is of uneven contour and legible printing cannot be accomplished. Upon sensing that the envelope is in a position to accept printing, the computer controls the print head to print identifying information on the depository envelope. The identifying information will depend on information provided by the customer and the programming of the computer by the bank or other financial institution operating the ATM. The identifying information may include such items as customer name, bank name, account number, transaction number, time and date of transaction, and amount of deposit in human or machine readable characters. If desired by the financial institution operating the ATM, a computer can be programmed to print the identifying information more than once on the deposit envelope as it is moved past the print head by the transport.

In the event that printing is commenced on a depository envelope and the contour of the envelope then changes due to the presence of coins or folded currency or instruments, the first electrical switch means changes its electrical condition as a result of the differing levels between the probe and the tracking surface. This change in electrical condition of the first switch means causes the computer to be advised that an area of the depository envelope about to pass under the print head has a contour upon which legible printing cannot be accomplished. Upon noting this change of electrical condition of the first switch means, the computer ceases its operation of the print head until such time that the contour of the envelope at the probe and tracking surface is again level causing the first electrical switch means to return to its first electrical condition. Thereafter the computer reactivates the print head and continues printing the sequence of identifying information from the point of interruption.

It is contemplated that the present invention in its preferred form will accomplish the printing of a normal sequence of transaction identifying information at least two times on the most highly contoured of depository envelopes. However, in the event that the printing of identifying information is not complete when the trailing edge of the envelope passes the sensor tabs, the tabs rise and the second electrical switching means changes its electrical condition. This change in electrical condition is sensed by the computer which ceases operating the print head and thereafter attempts no further printing of the identifying information for that envelope.

If the envelope has an extraordinary number of highly contoured areas or the electrical switch means associated with the probe fails and indicates to the computer that the entire envelope would not accept legible printing, sufficient printing to identify the transaction might not be attempted. To minimize this problem the computer is programmed to disregard the signal from the electrical switch means associated with the probe in certain circumstances. As the speed at which the envelope moves is fixed by the transport, the time the sensor tabs will be depressed as the envelope passes is a predetermined value. This time period corresponds to the time the envelope is in position to accept printing. Likewise the time required to print the transaction identifying information is a second predetermined value. The computer records and compares the remaining amount of time the envelope will be in position to accept printing with the amount of time that will be required to print the transaction identifying information not yet printed on the envelope. When the available time for printing equals the time required for printing, the printer is operated regardless of the condition of the electrical switch means associated with the probe. This is done in the hope that at least a portion of the information will be successfully printed on the envelope.

BEST MODES FOR CARRYING OUT INVENTION

Figure 1:
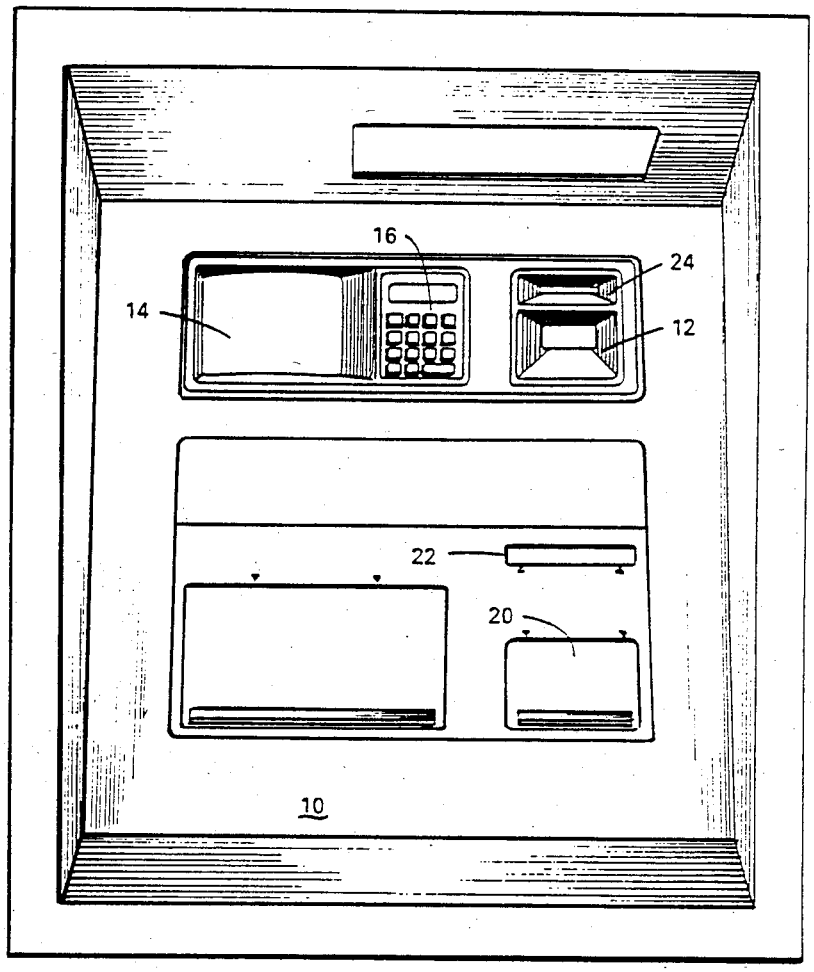
FIG. 1 is a plan view of a customer interface panel of an ATM incorporating a depository envelope labeling device according to the present invention.

The new depository envelope labeling device is designed to be used as an accessory to and in conjunction with the secure transport depository construction shown in U.S. patent application Ser. No. 597,230 filed Apr. 5, 1984, assigned to the assignee of the present invention and which is incorporated herein by reference in its entirety. Portions of the secure transport depository construction to which the present invention is connected are shown in the drawings.

Referring now to the drawings and particularly to FIG. 1, there is shown an Automatic Teller Machine (ATM) generally designated 10 which incorporates the improved depository envelope labeling device of the present invention. The ATM has a card slot 12 into which a customer inserts his credit or debit card in order to actuate the ATM. The card contains encoded information which identifies the customer, his bank or other financial institution, and his account. A card reader inside the ATM reads this encoded information, transforms it to electrical signals, and transfers this information to the computer which controls the operation of the ATM. The computer verifies the data input by the customer against information stored in its memory or communicates with other computers which are a part of a network to determine that the customer is authorized to conduct transactions using the ATM. If the customer is an authorized user, the ATM retains the customer's card while the customer conducts his transactions. If the customer is not an authorized user, his card is rejected. The ATM also incorporates a CRT screen 14 which is operated under the control of the computer to present a series of instructions to guide the customer in his use of the ATM. The ATM also incorporates a keyboard 16 which the customer uses to give instructions or input information into the ATM. The customer may initiate withdrawals from or deposits into his account, check account balances, transfer money between accounts, or perform other banking functions depending on the programming of the computer systems which control the operation of the ATM and store data concerning the customer's account.

When the ATM customer wishes to make a deposit into his account, he notifies the ATM of this fact by following the instructions displayed on CRT screen 14 for accomplishing a deposit using keyboard 16. Upon correctly completing the instructions for indicating the desire to deposit, the computer then causes the CRT to display an instruction to input the amount of the deposit to be made using keyboard 16. Once the customer has input the amount of the deposit, the CRT then displays an instruction advising the customer to remove a depository envelope from envelope storage drawer 20; to place the currency or instruments to be deposited into the envelope; to seal the envelope and place it into the depository slot 22. Upon input of the envelope into the depository slot 22, the envelope is captured by a transport mechanism later described and moved for storage to a secure compartment within the ATM.

Once the ATM has accepted the depository envelope, the customer's account is credited with the amount of the deposit indicated by the customer. When the customer has completed all transactions he wishes to conduct using the ATM, he follows the instructions displayed on the CRT screen to indicate that he is finished. After the concluding instruction is input by the customer using the keyboard, the customer's card is returned at card slot 12 and a receipt showing all transactions conducted by the customer at the ATM is printed inside the ATM and delivered at receipt delivery slot 24.

Figure 2:
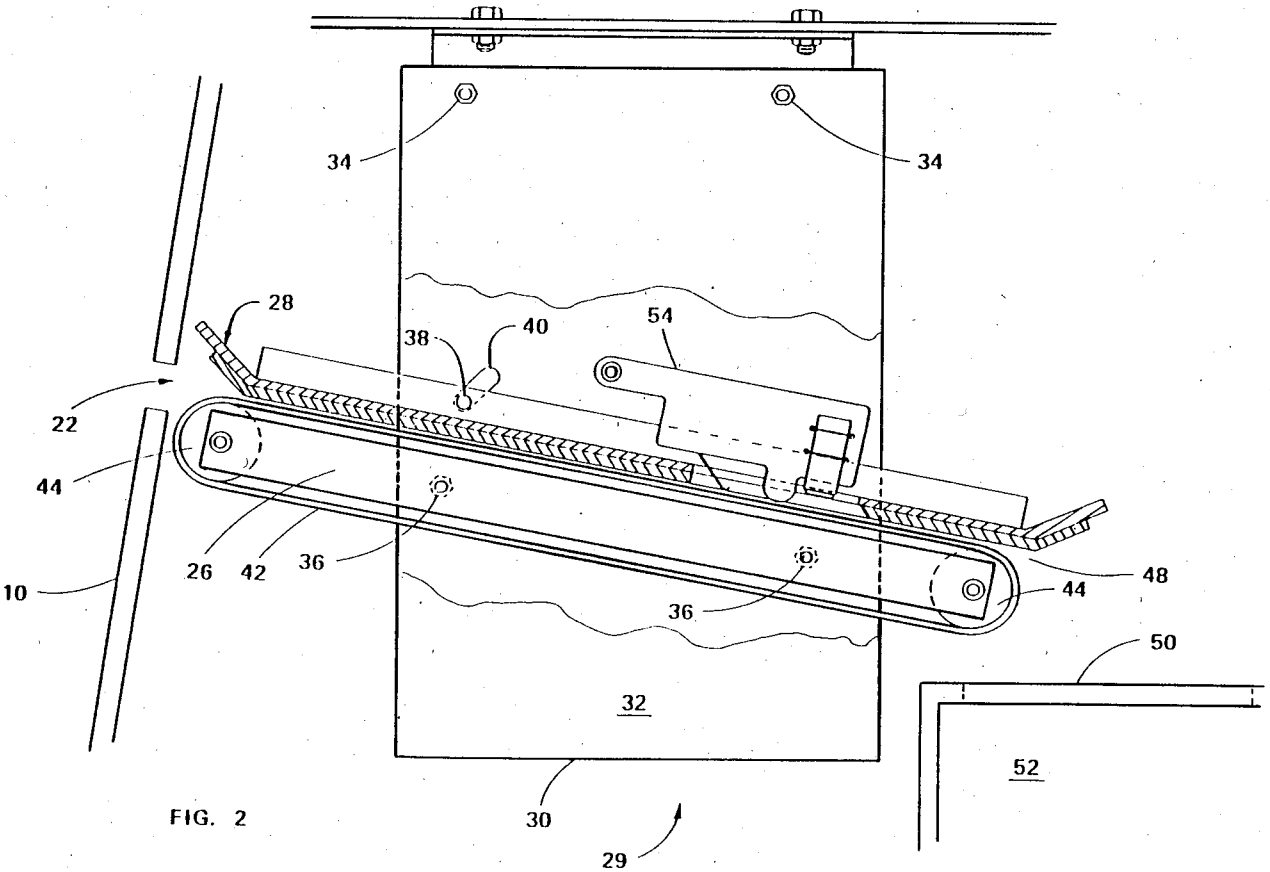
FIG. 2 is a partially sectioned side view of the envelope transport mechanism incorporating the preferred form of present invention located inside the ATM.

The apparatus which transports depository envelopes from the customer to the secure place of storage within the ATM is shown in FIG. 2. The transport generally indicated at 29 consists of a belt conveyor assembly 26 and a movable floating platen assembly 28 located adjacent to depository slot 22. The belt conveyor assembly 26 is rigidly mounted in a frame 30, having two parallel side walls 32 (see FIG. 4). The frame 30 is rigidly mounted to the inside structure of the ATM by fastening means 34.

The belt conveyor assembly 26 is rigidly mounted to the side walls 32 by fastening means 36. The movable floating platen assembly 28 incorporates pins 38 which ride in angled slots 40 in side walls 32. Conveyor belt 42 of conveyor belt assembly 26 is driven by rollers 44 which are rotated in the clockwise direction as shown in FIG. 2 by conventional motor drive means.

Because angled slots 40 allow floating platen assembly 28 to move in a direction that is upward away from conveyor belt assembly 26 and in the direction of travel of the upper flight of conveyor belt 42, depository envelopes inserted into slot 22 are pinched between the upper flight of belt 42 and floating platen assembly 28. The reaction force of the envelope in response to the pinching action causes the floating platen assembly to move in the direction of the upper flight of belt 42. As a consequence of the upward angle of slots 40, the lateral movement of the floating platen assembly is accompanied by a rising movement away from the fixed conveyor belt assembly 26, providing access for the envelope to be pulled between the upper flight of the conveyor belt and the floating platen assembly. The envelope once between the conveyor belt and floating platen assemblies is pulled along the upper flight of the conveyor belt until it reaches a discharge into the transport generally labeled 48. As the envelope exits the transport, it falls into an opening 50 in a safe or other secure container 52. This secure contained may be of the type described in U.S. Pat. No. 4,312,277 or may be of other conventional construction. The depository envelope labeling apparatus of the present invention generally indicated at 54 is shown at its location inside frame 30.

The method by which an envelope of non-uniform thickness is transported from depository slot 22 to secure container 52 as well as the construction of transport 29 are described in detail in pending U.S. patent application Ser. No. 597,230 mentioned previously. It should be noted that certain features of the transport construction described in said application have been omitted herein for the sake of brevity and clarity and that the position of conveyor belt assembly 26 and floating platen assembly 28 shown herein are inverted from the positions shown and described in U.S. patent application Ser. No. 597,230. The device described in the prior pending application may be operated in the inverted position thus eliminating the need to utilize springs or force application means other than gravity to hold the conveyor belt assembly and floating platen assemblies adjacent.

It will be apparent to those skilled in the art that the conveyor belt assembly may be operated over a wide variety of speeds. The inventors have found that for purposes of the invention it is best to operate the transport such that the upper flight of belt 42 moves at a uniform speed of approximately 14 centimeters per second.

Figure 3:
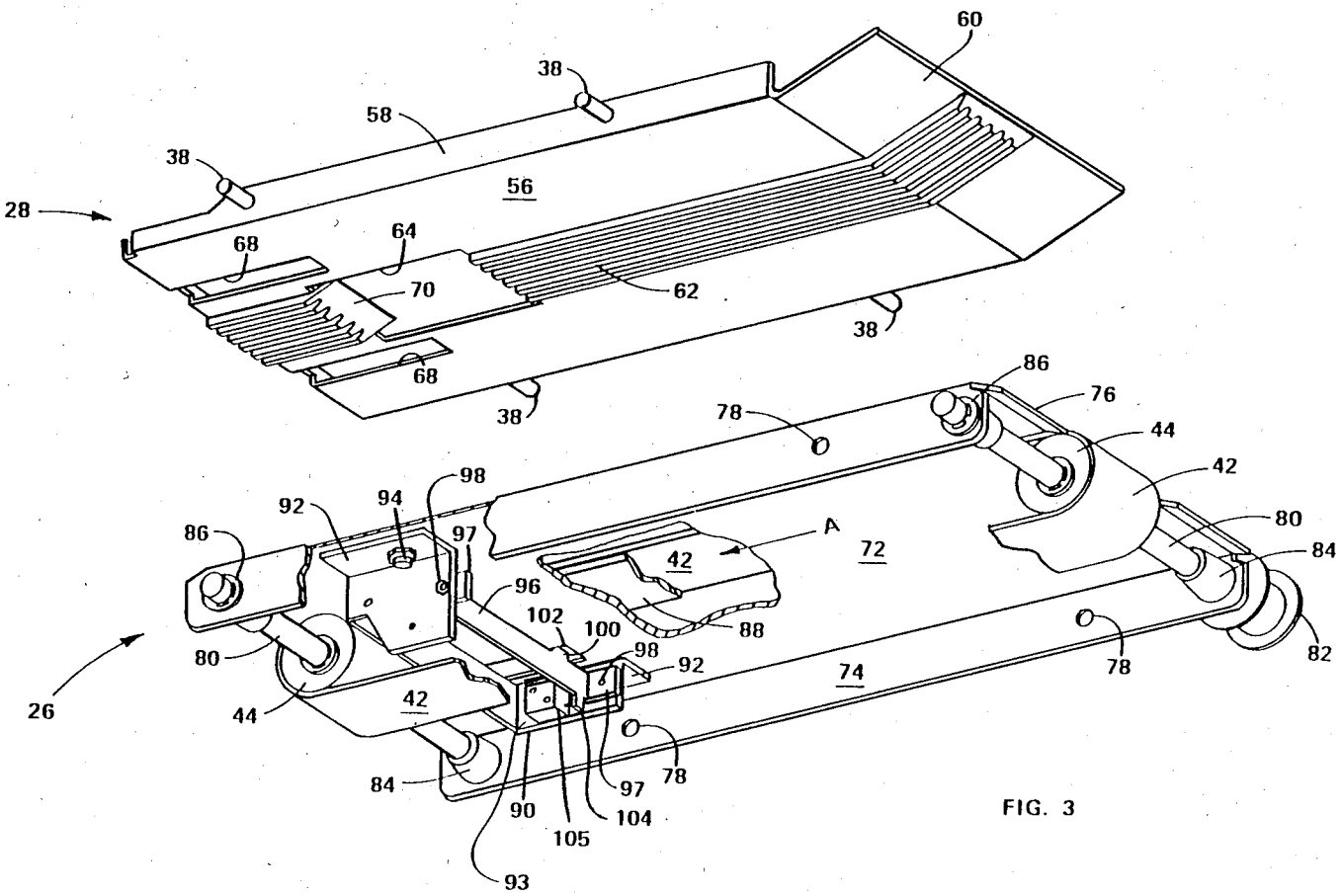
FIG. 3 is a perspective view of the floating platen assembly and the fixed conveyor belt assembly of the envelope transport mechanism.

Floating platen assembly 28 and fixed conveyor belt assembly 26 are shown in detail in FIG. 3. Floating platen assembly 28 includes a formed plate 56 having upturned side flanges 58 and an upwardly tapered leading edge 60. Pins 38 are rigidly mounted to side flanges 58 by press fit or other means. A raised rib surface 62 runs longitudinally along formed plate 56 and is rigidly mounted thereto by fastening means. The raised rib surface is made of a slippery substance such as plastic so as to minimize frictional forces resisting the transport of depository envelopes. A hole 64 and two slots 68 are cut in formed plate 56 for purposes which will become apparent later. The portion of ribbed surface 62 to the posterior of hole 64 incorporates a tapered edge 70 to avoid catching or tearing depository envelopes as they are pulled across hole 64.

Belt conveyor assembly 26 includes a formed plate 72 having downturned side flanges 74 and a downwardly tapered leading edge 76. Side flanges 74 incorporate holes 78 to accept fastening means for rigidly mounting formed plate 72 to side walls 32 of transport frame 30. Rollers 44 are rigidly mounted to shafts 80, one of which incorporates a pulley 82 which is connected by belt means to conventional motor drive means. The belt and drive means are adapted to drive belt 42 in the direction of arrow A as shown in FIG. 3. Shafts 80 ride in bearings 84 which extend through side flanges 74. A set of clips 86 cooperate with grooves in shaft 80 to hold the shafts in position.

Plastic strip 88 is longitudinally mounted on the upper surface of formed plate 72 by fastening means. The upper flight of conveyor belt 42 travels on top of plastic strip 88 which serves to reduce frictional resistance to its movement. A U-shaped bracket 90 having legs 92 and walls 93 is rigidly mounted to the underside of formed plate 72 by fastening means 94. Switch actuator 96 incorporates tabs 97 and is pivotally mounted on pins 98 which extend from bracket walls 93 through access holes in tabs 97. Switch actuator 96 also incorporates a pair of sensor tabs 100 (see FIGS. 4 and 6) which extend through slots 102. Sensor tabs 100 also extend through slots 68 in plate 56 when the floating platen assembly and fixed conveyor belt assemblies are adjacent. Sensor tabs 100 are of sufficient length that they are depressed and switch actuator 96 is caused to rotate by an envelope passing through the transport. Switch actuator 96 also incorporates a switch actuator ear 104. A switch 105 is rigidly mounted to bracket wall 93 by fastening means 106. Actuator ear 104 contacts a blade 108 of switch 105, such that the switch is in one electrical position when ear 104 is against blade 108 and in another electrical position when ear 104 is not adjacent to blade 108 due to rotation of switch actuator 96.

Depending on the type of switch used and the length of sensor tabs 100, it may be necessary to apply a force using a spring or other means to cause switch actuator ear 104 to apply sufficient pressure to blade 108 when no depository envelope is in contact with sensor tabs 100. The direction of this applied force which may be required is clockwise about pin 98 in FIG. 6.

Figure 4:
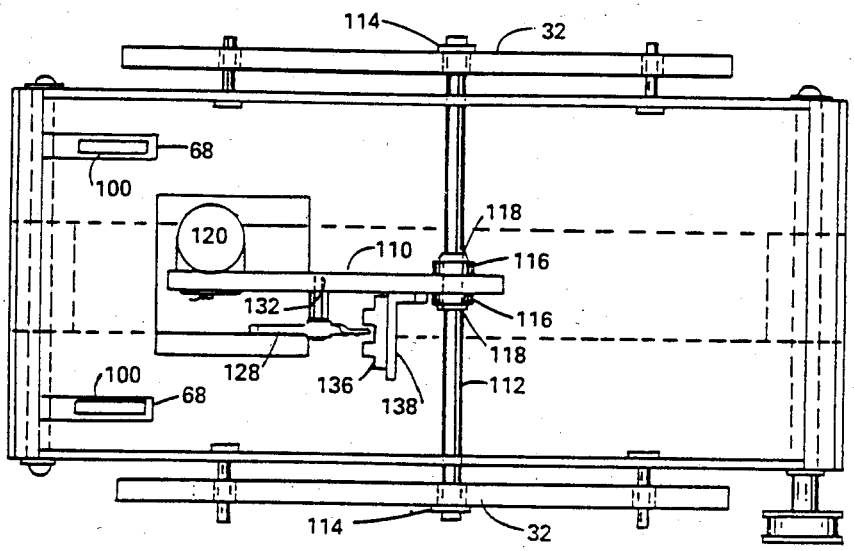
FIG. 4 is a top view of the envelope transport mechanism showing the details of the depository envelope labeling mechanism of the present invention.
Figure 5:
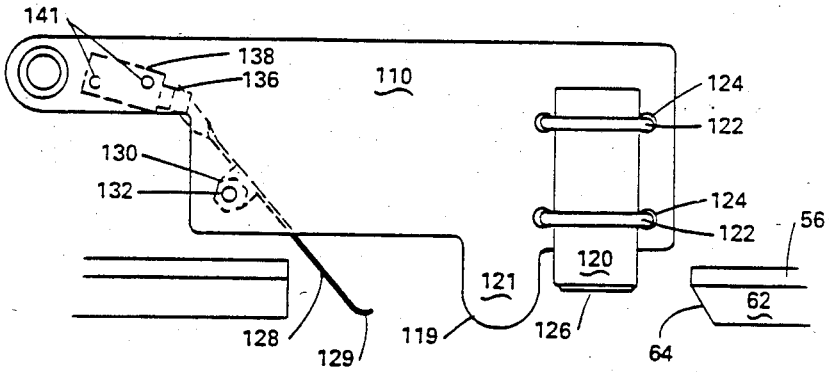
FIG. 5 is a side view of the depository envelope labeling mechanism.

A top view and a side view of the envelope labeling device of the preferred form of the present invention is shown in FIGS. 4 and 5 respectively. The device includes a printer carriage plate 110 pivotally mounted on a shaft 112. Shaft 112 extends between side plates 32 of transport 29. A pair of clips 114 cooperate with grooves in shaft 112 to prevent lateral movement of the shaft. A pair of spacers 116 are positioned on shaft 112 on both sides of carriage plate 110 to prevent lateral movement of the carriage plate. Clips 118 cooperate with grooves in shaft 112 to hold the spacers in position.

Carriage plate 110 incorporates a tracking means in the form of tracking shoe 121 on its lower surface. Tracking shoe 121 includes a tracking edge 119. The tracking shoe is of sufficient length that it rides on belt 42 and extends through hole 64 in floating platen assembly 28 when no depository envelope is located under the carriage plate in the transport. Tracking shoe 121 is sufficiently long and carriage plate 110 is designed such that tracking edge 119 may remain in contact with the upper flight of belt 42 when the floating platen assembly 28 rises due to the presence of an envelope in the transport. Tracking edge 119 is sufficiently smooth and rounded so that it will not grab or tear depository envelopes which pass through the transport and will track the depository envelopes riding on the top face of said envelopes following the contour of their upper surface, thereby detecting the position of said surface. It should be understood that although in the preferred embodiment the tracking shoe detects the position of the envelope by engaging the surface, in other embodiments the surface position could be tracked by non-contact sensors.

A print head 120 is rigidly mounted to carriage plate 110 via holding means 122 which extend through mounting holes 124 in the carriage plate. Print head 120 is mounted such that it is located over hole 64 and floating platen assembly 28. The print head may be an ink jet type such as a Model 2225 produced by the Hewlett Packard Company which is shown. The print head may also be an impact dot matrix type such as a Model MS 520 produced by the Microlys-Seitz Company.

The print head has a face 126 through which printing operations are conducted. The print head face includes a series of holes (not shown) arranged in a line perpendicular to the direction of envelope travel. In response to control signals, ink may be selectively sprayed from the holes onto the envelope. The print head face is mounted such that it is recessed upwards from tracking edge 119. The distance said print head face is recessed corresponds to the optimal distance the face should be located away from the media on which it is printing as recommended by the manufacturer of the print head.

The printing of transaction identifying information is accomplished by controlling print head 120 through signals produced by the operation of a program in the computer in a manner well-known in the prior art. The program selects the transaction identifying characters that have been designated to be reproduced on the envelope. The computer then correlates each character with a predetermined series of lines of dots which represents each character. Each line of dots can be made broken or solid by selectively actuating the dot producing apparatus of the print head. As the speed at which the envelope is transported is fixed by the speed of conveyor belt 42, the spacing between the lines of dots printed on the envelope can be selected and thus characters composed of lines of dots can be produced. Through appropriate programming an infinite variety of letters, numbers, and symbols can be printed on deposit envelopes in this manner.

As tracking edge 119 is always in direct engagement with the upper surface of the envelope upon which printing is to be conducted despite any variation in thickness, and because print head 120 is rigidly mounted to the carriage plate 110, print head face 126 always remains the optimal printing distance from the face of the envelope regardless of any variation in envelope contour which may be caused by the presence of coin or folded currency or instruments. It should be noted that while ideally the tracking surface 119 and the face 126 of print head 120 should remain level with respect to each other as printing is accomplished, some variation is permissible. The pivotal mounting of carriage plate 110 causes some variance in the distance the envelope surface is away from the print head face. However, the inventors have found this variance to be insignificant when the print head is mounted in close proximity to the tracking surface.

Figure 6:
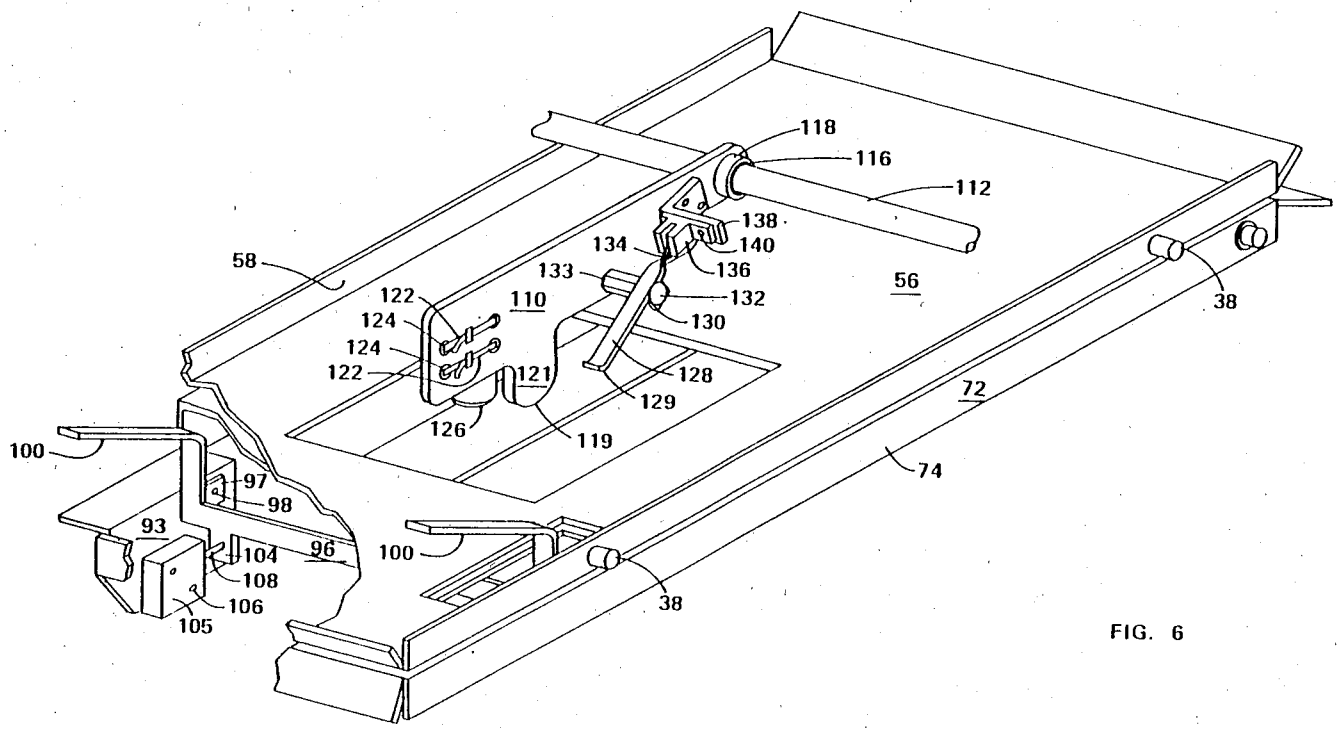
FIG. 6 is a partially sectioned perspective view of the floating platen assembly and fixed conveyor belt assembly and the depository envelope labeling mechanism of the present invention.

A probe 128 is shown in FIGS. 5 and 6 located forward in the transport of tracking edge 119. Probe 128 incorporates a curved face 129 which normally extends through hole 64 in the floating platen assembly. Probe 128 is a formed construction and has two downward facing ears 130. Probe 128 is pivotally mounted to carriage plate 110 by a pin 132, which extends through access holes in ears 130 through a bushing 133 and is rigidly fixed to carriage plate 110 by threading means.

Probe 128 terminates in a twisted end 134, the plane of which is perpendicular to curved face 129. A slotted optical switch 136 is mounted such that twisted end 134 will rotate through its sensor region. Slotted optical switch 136 is further mounted such that twisted end 134 will be centered within its sensor region when curved face 129 is at the same level with tracking edge 119. Slotted optical switch 136 exhibits one electrical condition when twisted end 134 is within its sensor region and a second electrical condition when twisted end 134 is outside its sensor region. The width of the twisted end can be varied to affect the sensitivity of the probe as will be described later. A Model OPB 824A slotted optical switch manufactured by TRW Optron, a division of TRW Inc., has been found to be a suitable slotted optical switch for use in this form of the invention. Slotted optical switch 136 is mounted to an L-shaped bracket 138 by fastening means 140. L-shaped bracket 138 is fastened to carriage plate 110 by fastening means 141.

Operation of Depository Envelope Labeling Mechanism

Figure 7:
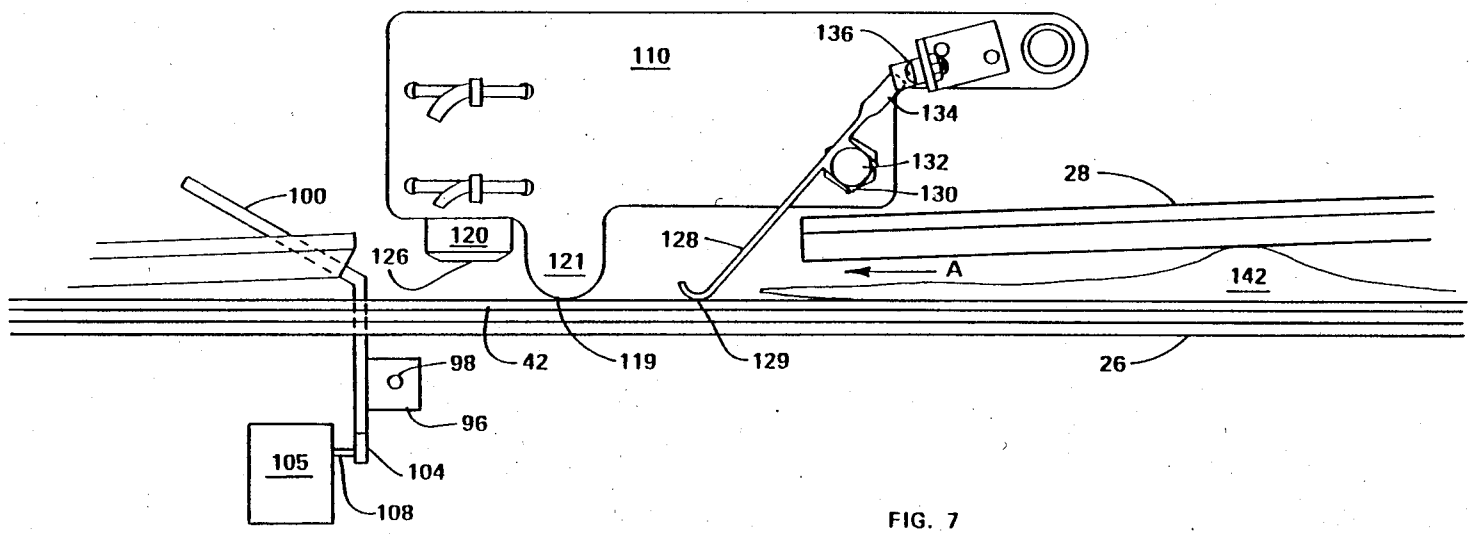
FIG. 7 is a sectional view of the transport mechanism and the depository envelope labeling mechanism as a depository envelope of uneven thickness approaches the labeling mechanism of the present invention.
Figure 8:
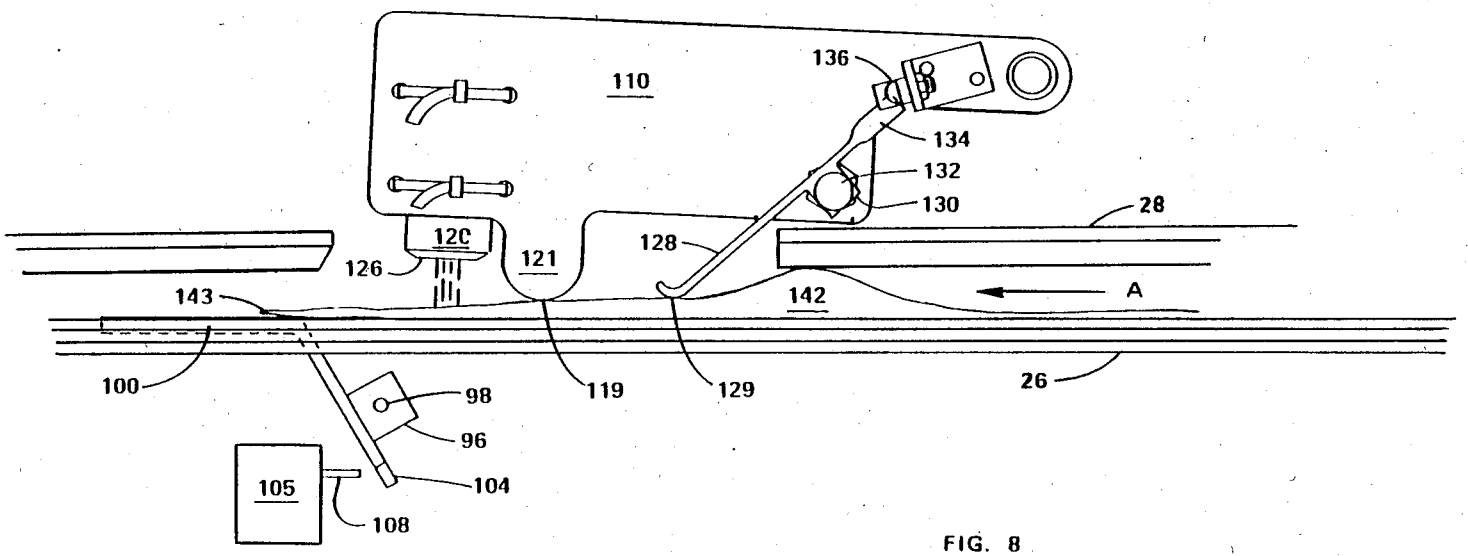
FIG. 8 is a sectional view of the envelope transport mechanism showing the depository envelope printing mechanism of the present invention as a relatively flat portion of an envelope of uneven thickness passes underneath.
Figure 9:
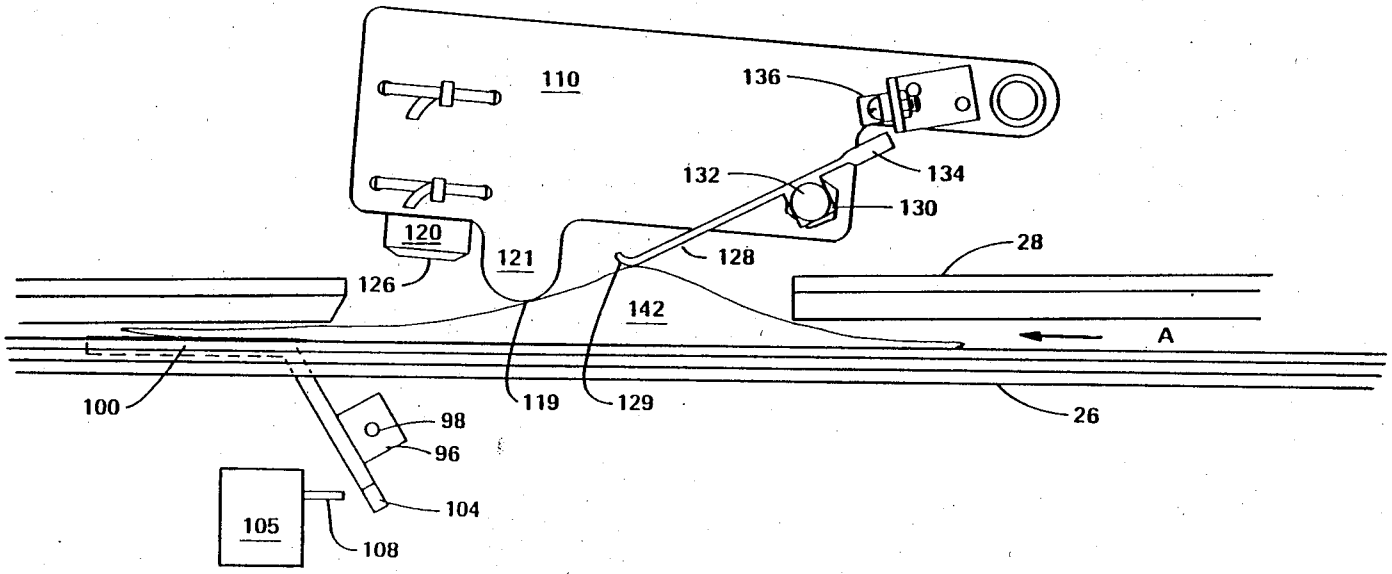
FIG. 9 is a sectional view of the transport mechanism and the envelope depository printing mechanism of the present invention as a highly contoured area of an envelope of uneven thickness passes under the labeling mechanism.

The passage of a depository envelope of non-uniform thickness through the transport mechanism and under the labeling device of the present invention is shown in FIGS. 7, 8, and 9. In FIG. 7 depository envelope 142 is shown traveling in the direction indicated by arrow A between floating platen assembly 28 and fixed conveyor assembly 26 which are separated due to the presence of the envelope. Envelope 142 has an uneven contour as a result of its containing coin or folded currency or instruments. Curved face 129 of probe 128 and tracking edge 119 are shown riding on the upper flight of belt 42. In this position twisted end 134 is centered in the sensor region of slotted optical switch 136.

Switch actuator 96 is shown in its "no envelope" position with sensor tabs 100 raised into the gap located between the upper floating platen assembly and lower fixed conveyor belt assembly, the gap being created by the stacking of raised rib surface 62, the upper flight of conveyor belt 42, and plastic strip 88. Switch tab 104 is shown in contact with blade 108 of switch 105 which is in its first electrical position indicating that no envelope is present.

In FIG. 8 envelope 142 is shown having moved so that it is located under tracking edge 119 of tracking shoe 121 and curved face 129. The leading edge 143 of envelope 142 has contacted sensor tabs 100 causing switch actuator 96 to rotate counterclockwise about pin 98. As a consequence, ear 104 has moved away from blade 108 of switch 105 causing the switch to assume its second electrical condition. The change in electrical condition of switch 105 is sensed by the computer controlling the operation of the transport and causes the computer to be aware that a portion of a depository envelope is underneath the print head. A program in the computer then operates print head 120 to print identifying information on the envelope as it passes under face 126 of print head. The computer will continue to print the sequence of identifying information associated with the deposit on the envelope until the entire sequence is printed provided; (a) switch 105 continues to hold its second electrical condition indicating the presence of an envelope under the print head in the transport and (b) twisted end 134 of probe 128 remains in the sensor region of slotted optical switch 136 indicating that the height of the depository envelope under probe 128 is approximately equal to the height of the depository envelope under tracking edge 119 which indicates that the contour of the envelope is sufficiently flat to accept legible printing.

As a highly contoured area of envelope 42 upon which printing would be distorted or illegible approaches face 126 of the print head (FIG. 9), curved face 129 is caused to rise by the upper surface of the envelope, which causes probe 128 to rotate about pin 132. Rotation of probe 128 causes twisted end 134 to rotate outside of the sensor region of slotted optical switch 136 resulting in a change in the electrical condition of the slotted optical switch. The change in electrical condition is noted by the computer controlling the operation of print head 120 which operates to finish printing the character being printed and then interrupts the printing sequence. As the envelope continues to pass underneath curved face 129 and tracking edge 119, the tracking edge again becomes approximately level with the curved face, thus causing twisted end 134 of probe 128 to return to within the sensor region and slotted optical switch 136 to return to its original condition. This change in electrical condition is noted by the computer which recommences operation of print head 120 and causes the sequence of characters printed on the envelope to be continued from the point of interruption. Thereafter the computer continues printing the identifying information on the envelope until the sequence is again interrupted due to excessive contour in the upper face of the envelope or the sequence of identifying information is completed.

While in FIGS. 7, 8, and 9 the upper face of the depository envelope 142 is shown rising with increasing envelope thickness, it is readily apparent that the operation of probe 128 and slotted optical switch 136 will likewise operate to interrupt the printing sequence of identifying information in situations where the contour of the upper face of the envelope is falling due to decreasing envelope thickness. In such cases curved face 129 falls onto the envelope surface below the level of tracking edge 119. This results in twisted end 134 rotating to an area outside of the sensor area of slotted optical switch 136 opposite that occupied during times of rising contour.

Figure 10:
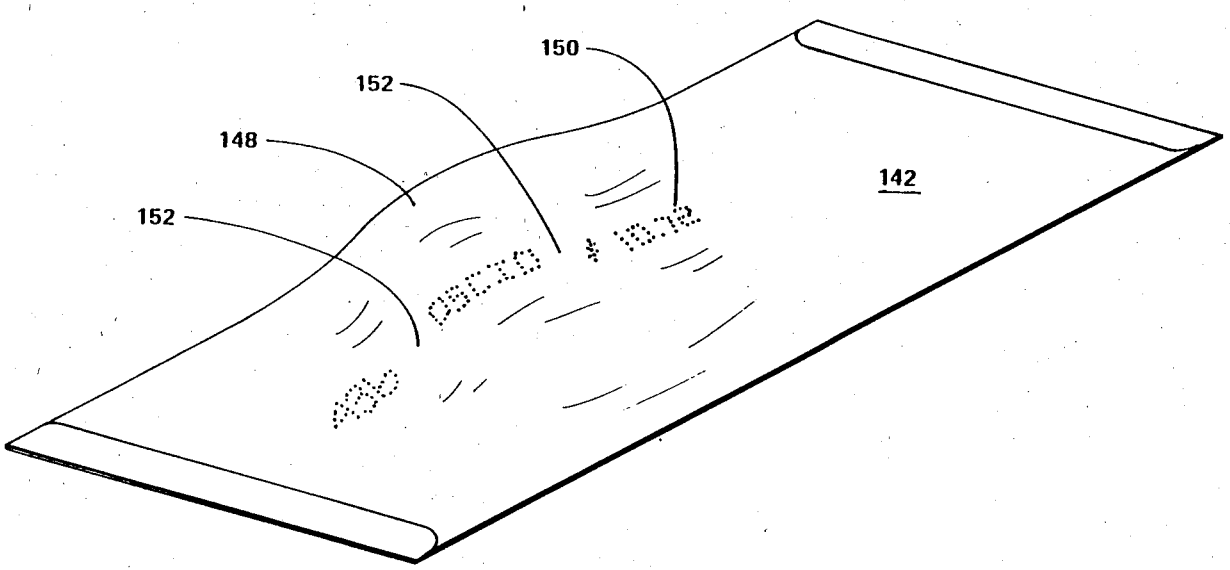
FIG. 10 is a perspective view of a depository envelope of uneven thickness labeled using the depository envelope labeling mechanism of the present invention.

FIG. 10 shows envelope 142 having a bulging area 148 due to the presence of coin or folded notes or instruments. Transaction identifying character sequence 150 is shown having been interrupted in two places 152 due to high contour.

It is contemplated that the printing of all identifying information on the depository envelope will be completed well in advance of the trailing end of the envelope reaching the print head. If, however, printing operations are not completed due to a substantial number of contoured areas across the envelope, it becomes necessary to terminate the printing process upon the trailing edge of the envelope reaching the print head. When the trailing edge of envelope 142 clears sensor tabs 100, the sensor tabs rise causing switch actuator 96 to rotate. This rotation causes ear 104 to return and contact blade 108 of switch 105 causing switch 105 to assume its first electrical condition which is indicative of no envelope being present under the print head. A change in electrical condition is noted by the computer which ceases operation of the print head and thereafter abandons attempts to print transaction identifying information for the envelope.

As was previously mentioned, the present invention is designed to be used in conjunction with different styles and varieties of print heads. As some types of print heads are better adapted to print on contoured envelope surfaces, the sensitivity of the probe-slotted optical switch construction may be decreased so that the computer continues printing operations on areas of higher variation and contour. Decreasing sensitivity may be accomplished by increasing the width of twisted end 134. Increasing the width of the twisted end will require that there be a larger difference between the levels of tracking edge 119 and curved face 129 before the twisted end will rotate outside the sensor region of slotted optical switch 136 and printing is interrupted. Likewise, print heads which are more sensitive to changes in envelope contour may be accommodated by increasing the sensitivity of the apparatus which may be accomplished by decreasing the width of twisted end 134.

For purposes of the present invention it has been found best to arrange the width of twisted end 134 so that printing is interrupted whenever the absolute value of the slope of the envelope surfaces between the tracking surface 119 and the curved face 129 exceeds approximately 25%. It should also be mentioned that for purposes of the present invention it has been found to be best to locate the curved face approximately two (2) centimeters in advance of the tracking surface as this provides sufficient time for the computer to complete the printing of the last character before the highly contoured area of the envelope reaches print head face 126. It will be understood that other types of level sensors could be substituted for the probe-slotted optical switch arrangement and that such sensors could be positioned at other distances in advance of or behind the tracking surface.

Figure 11:
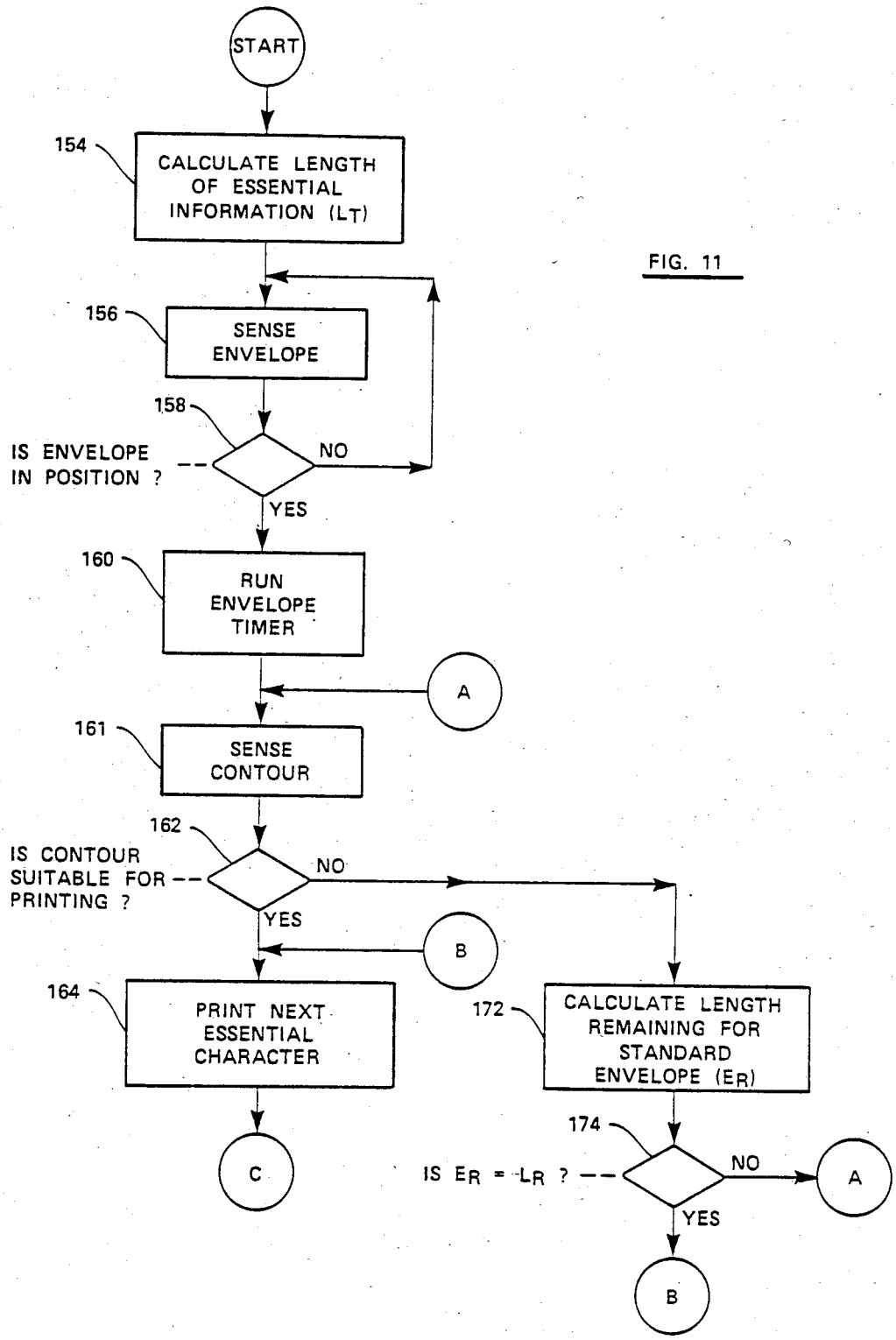
FIGS. 11 and 12 comprise an instruction flow diagram of the preferred form of the computer instructions used for control of the depository envelope printing mechanism of the present invention, which computer instructions insure that an attempt to print essential transaction identifying information is made for each envelope.
Figure 12:
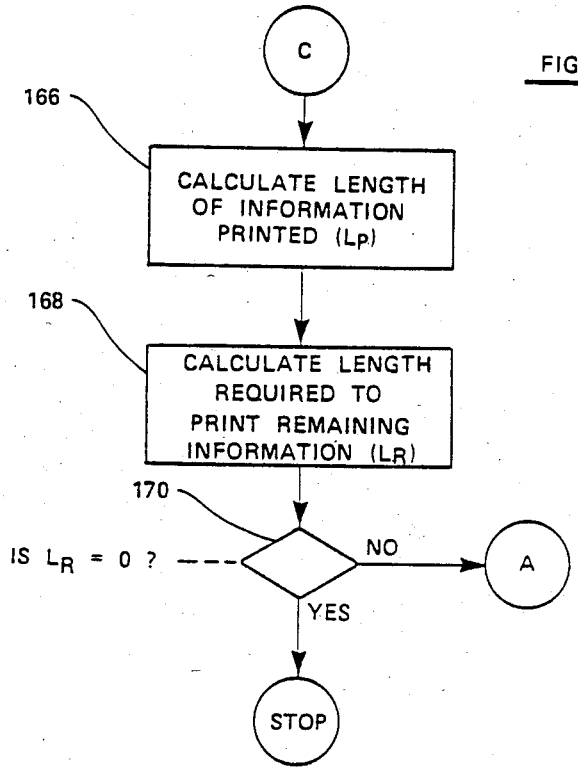

To avoid the difficulties that arise when no transaction identifying information is printed on the envelope, the computer is programmed to attempt printing regardless of the electrical condition of slotted optical switch 136 in the event the printing of a preselected portion of the sequence transaction identifying information considered essential would not otherwise be attempted at least once for the envelope. This essential portion may be the entire sequence of transaction identifying information or a lesser portion thereof. In the preferred embodiment, this is accomplished by the computer according to the flowchart in FIGS. 11 and 12. The computer calculates the length of envelope required to print the entire essential sequence of transaction identifying characters on the envelope ($L_T$) in a subroutine 154. The signal indicating depression of sensor tabs 100 is received by the computer at 156 to indicate that envelope 142 is in position to accept printing. A decision subroutine 158 defers operation of print head 120 until the envelope is in position. The computer begins executing a timing program 160 as sensor tabs 100 are depressed by the leading edge of envelope 142. The condition of switch 136 which indicates the contour of the envelope is received by the computer at contour sensing step 161 and decision routine 162 operates to control further execution of the instructions depending on whether the envelope contour is sufficiently flat to accept legible printing. If the envelope is sufficiently flat to accept printing, a print subroutine 164 operates to print successive characters of transaction identifying information. Each time a character of the essential sequence is printed, the length of the essential characters already printed on the envelope ($L_P$) is calculated in subroutine 166. The length of envelope required to print the remaining characters in the essential information ($L_r$) is calculated in routine 168 by determining the difference between $L_t$ and $L_p$. The computer is thus programmed to calculate and store information on the time period and length of envelope required to print the essential portion of the sequence of transaction identifying information one time on the envelope. For each portion of the essential information actually printed on envelope 142 the envelope length required to print that portion is deducted from the stored value which represents the length required to print the entire essential character portion. If the entire essential portion is printed, the value of $L_r$ drops to zero in advance of the envelope passing out from under the print head and decision routine 170 having determined that all essential information has been printed, no further activity is carried out by the computer in response to the program. If the contour of envelope 142 exceeds that which is permissible to have legible printing, decision routine 162 operates to interrupt the printing of essential characters. When printing is interrupted subroutine 172 calculates the distance remaining before envelope 142 passes out under print head 120 ($E_r$). This can be accomplished because envelope 142 is of known length and moves at the known speed of belt 42. From timing routine 160 and the belt speed the length of envelope already past print head 120 is calculated. The length of envelope past the print head is subtracted from the known standard envelope length to obtain $E_r$. Decision routine 174 compares $E_r$ to the length of envelope required to print the remaining essential characters ($L_r$) and as long as $E_r$ is greater than $L_r$ the printing of esential characters is deferred as long as envelope contour is excessive. If however the stored value for the length required to print the essential portion ($L_r$) becomes equal to the remaining envelope length ($E_r$) as calculated by the computer, decision routine 126 acts as print override means and recommences computer operation of the print head to print the remainder of the essential portion regardless of the electrical condition of the slotted optical switch. This situation occurs only when the envelope has an extraordinary number of high contour areas so that little printing can be conducted; and when the probe-slotted optical switch combination fails resulting in the production of a false signal representing constantly high envelope contour. Attempting the printing of the essential sequence of transaction identifying information on the envelope in such circumstances increases the probability that the essential portion is printed on the envelope and is available to aid the transaction verification process.

The foregoing new depository envelope labeling device enables the printing of customer identifying and amount information directly on depository envelopes which have uneven contours due to the presence of coin or folded notes or instruments. This reduces the probability that the identifying information will be illegible due to inability to print on contoured envelope surfaces and eliminates the need to apply identifying information using labels. In addition, use of the present invention eliminates the need to hold the deposit envelope stationary to apply identifying information resulting in faster acceptance of deposits and reduced transaction times.

Thus the new depository envelope labeling device achieves the above-stated objectives, eliminates difficulties encountered in the use of prior devices, and solves problems and obtains the desirable results described herein.

In the foregoing description certain terms have been used for brevity, clarity, and understanding; however, no unnecessary limitations are to be implied therefrom because such terms are for descriptive purposes and are intended to be broadly construed. Moreover, the description and illustrations given are by way of example and the invention is not limited to the exact details shown or described.

Having described the features, discoveries, and principles of the invention, the manner in which it is constructed and operated, and the advantages and useful results obtained, the new and useful structures, devices, elements, arrangements, parts combinations, systems, equipment operations, and relationships are set forth in the appended claims.

We claim:

1. A method of printing transaction identifying characters associated with a deposit made into a depository envelope receiving machine on a depository envelope susceptible of uneven thickness contour, said method comprising the steps of:

moving the envelope along an envelope path from an entrance to the path to an end of the path;

detecting the position of a surface of the envelope upon which the transaction identifying characters are printed with tracking means;

printing with a printing device transaction identifying characters on the envelope as the envelope moves along the envelope path; and moving the printing device closer to or further from the envelope surface upon which transaction identifying characters are printed to maintain a predetermined distance between the printing device and said envelope surface level of the envelope surface tracked.

2. The method according to claim 1 additionally comprising the steps of sensing the presence of the envelope in a position to accept printing from the printing device and inhibiting the operation of the printing device whenever the presence of the envelope is not sensed.

3. The method according to claim 1 additionally comprising the steps of:

sensing the level of the envelope surface upon which transaction identifying characters are printed along the envelope path a distance from the tracking means;

comparing the levels of the envelope surface at the area sensed and at the tracking means; and interrupting the operation of the printing device over that portion of the envelope for which the magnitude of difference in the levels compared exceeds a predetermined value.

4. The method according to claim 3 additionally comprising the step of recommencing operation of the printing device after interruption with the character in the sequence of transaction identifying characters following the last character printed on the envelope before interruption.

5. The method according to claim 4 additionally comprising the steps of:

sensing the presence of the envelope in a position in which it can accept printing from the printing device; and inhibiting the operation of the printing device when the presence of the envelope is not sensed.

6. The method according to claim 3 additionally comprising the steps of:

sensing the distance of a predetermined envelope portion from the printing device;

calculating a fourth distance representing the distance required to print a preselected portion of transaction identifying information not yet printed;

comparing the distance of the preselected portion of the envelope from the printing device with said fourth distance; and recommencing printing with said preselected portion of transaction identifying information when the distances compared are in a predetermined ratio regardless of the difference in the compared levels of the envelope surface.

7. Apparatus associated with a depository envelope receiving machine for printing transaction identifying characters associated with a depository envelope susceptible of eneven thickness contour, the machine having transport means for moving the envelope along an envelope path in the machine, said apparatus comprising:

tracking means for detecting the position of an envelope surface upon which transaction identifying characters are to be printed;

printing means for printing the transaction identifying characters on the envelope; and control means for controlling the printing means to print the transaction identifying characters on the envelope according to a predetermined contour characteristic of the envelope as the envelope moves along the envelope path.

8. Apparatus according to claim 2 wherein the printing means is a dot matrix printer.

9. Apparatus according to claim 8 wherein the printing means is an ink jet printer.

10. Apparatus according to claim 7 and additionally comprising:

level sensing means for sensing the level of a first portion of the envelope surface upon which transaction identifying characters are printed;

measuring means for measuring the distance of said first portion from a second portion tracked by said tracking means; and interrupting means operatively connected to said measuring means for interrupting printing of transaction identifying characters when said distance exceeds a first predetermined value.

11. Apparatus according to claim 10 additionally comprising means for recommencing printing of transaction identifying characters when said distance decreases to a second predetermined value.

12. Apparatus according to claim 11 wherein said first and second predetermined values are equal.

13. Apparatus according to claim 10 additionally comprising an entrance to said envelope path, wherein the level sensing means is located between said entrance and said tracking means in the envelope path.

14. Apparatus according to claim 10 additionally comprising:

sensing means for sensing the distance of a predetermined envelope portion from the printing means;

calculating means for calculating a third distance representing the distance required to print a preselected portion of transaction identifying information not yet printed;

comparing means for comparing said distance of the predetermined envelope portion from the printing means with said third distance; and means for recommencing printing with said preselected portion of transaction identifying information when said distances compared have a predetermined ratio, regardless of the distance measured by the measuring means.

15. Apparatus according to claim 14 wherein the predetermined ratio is 1:1.

16. Apparatus according to claim 14 wherein the preselected envelope portion is a trailing edge of the envelope.

17. Apparatus according to claim 7 wherein the tracking means engages the envelope surface to detect the position of the envelope surface.

18. Apparatus according to claim 17 and further including mounting means for floatably mounting said tracking means relative to said printing means for enabling said tracking means to move with the thickness contour of the envelope.

19. Apparatus according to claim 17 and further including carriage means, said tracking means and said printing means being fixed on said carriage means.

20. Apparatus according to claim 19 wherein said carriage means comprises a carriage plate, and said tracking means comprises a tracking shoe forming an integral portion of said carriage plate.

21. Apparatus according to claim 19 wherein the machine includes a housing and said apparatus includes pivot means attached to the housing, said pivot means floatably mounting said carriage means on the housing.

22. Apparatus according to claim 17 wherein said tracking means comprises a tracking shoe floatably mounted relative to the envelope path, said tracking shoe including a tracking surface for engaging the envelope surface upon which transaction identifying characters are to be printed; and further comprising:

level sensing means for sensing the level of the envelope upon which transaction identifying characters are printed, said sensing ocurring at a distance away from the place of engagement of the envelope by said tracking surface;

measuring means operatively connected to said tracking means for comparing the level of the envelope surface engaged by said tracking surface with the level of the surface sensed by said level sensing means; and interrupting means operatively connected to said measuring means for interrupting the printing by said printing means whenever the difference in the levels compared by said measuring means exceeds a predetermined value.

23. Apparatus according to claim 22 additionally comprising recommencing means for recommencing the printing by said printing means when said difference in levels no longer exceeds said predetermined value.

24. Apparatus according to claim 22 additionally comprising carriage means and wherein said level sensing means includes a probe pivotally mounted to said carriage means, said probe having a curved face for contacting the envelope surface and a twisted portion; and a slotted optical switch rigidly mounted on said carriage means and including a sensor region; said twisted portion moving within said sensor region whenever the distance between the levels of said curved face and said tracking surface is less than said predetermined value, and said twisted portion moving out of said sensor region and said slotted optical switch generating an interrupting signal when the distance between the levels of said curved face and said tracking surface exceeds said predetermined value, said interrupting means being operably connected to said probe and actuable in response to said interrupting signal to interrupt the printing of transaction identifying characters.

* * * * *